US005513764A

United States Patent [19]

Harrison et al.

[11] Patent Number: 5,513,764

[45] Date of Patent: May 7, 1996

[54] STEMWARE ASSEMBLY INCLUDING A CRYSTAL STEM AND A CHINA FOOT AND METHOD OF MAKING THE SAME

[75] Inventors: David A. Harrison, Newton; Richard J. Hughes, Morrisville, both of Pa.

[73] Assignee: Lenox, Incorporated, Lawrenceville, N.J.

[21] Appl. No.: 189,204

[22] Filed: Jan. 31, 1994

[51] Int. Cl.[6] ..... A47G 19/22

[52] U.S. Cl. ..... 215/372; 215/374; 215/377

[58] Field of Search ..... 215/99.5, 372, 215/374, 377; 220/604, 636

[56] References Cited

U.S. PATENT DOCUMENTS

| | | | |
|---|---|---|---|
| 180,970 | 8/1876 | Wagner | 215/99.5 |
| 2,203,647 | 6/1940 | Cunningham | 215/99.5 |
| 2,660,039 | 11/1953 | Newell | 215/99.5 |
| 2,918,188 | 12/1959 | Todd | 215/99.5 |
| 3,369,687 | 2/1968 | Walls | 215/99.5 X |
| 3,393,819 | 7/1968 | Van De Walle et al. | 215/99.5 |
| 5,014,865 | 5/1991 | Sauber | 215/99.5 |

FOREIGN PATENT DOCUMENTS

| | | | |
|---|---|---|---|
| 1034603 | 4/1953 | France | 215/99.5 |
| 1236001 | 6/1960 | France | 215/99.5 |
| 2641960 | 7/1990 | France | 215/99.5 |
| 3839400 | 5/1990 | Germany | 215/99.5 |
| 2134374 | 8/1984 | United Kingdom | 215/99.5 |

*Primary Examiner*—Sue A. Weaver
*Attorney, Agent, or Firm*—Eckert Seamans Cherin & Mellott

[57] ABSTRACT

A stemware assembly includes bowl, stem and foot portions in which the bowl and stem are made of glass, preferably crystal, and the foot is made of ceramic, preferably china, and further in which the glass stem and the crystal foot are joined together by an adhesive, preferably an ultraviolet-curing adhesive, which is suitably translucent when cured.

15 Claims, 2 Drawing Sheets

STEMWARE ASSEMBLY INCLUDING A CRYSTAL STEM AND A CHINA FOOT AND METHOD OF MAKING THE SAME

BACKGROUND OF THE INVENTION

1. Field of the Invention

The invention relates to the field of dinnerware, glassware, and chinaware, and in particular to fine stemware. The invention concerns a fine stemware assembly that combines portions of crystal glass and china, rigidly attached in a manner that is compliant as to the differences in thermal expansion properties of the two materials. The stemware includes a bowl, stem and foot portion. At least one of these portions, preferably the foot portion, is china, and another is crystal, preferably the stem portion, which can be integrally formed of glass or lead crystal with the bowl. The dissimilar glass (crystal) and ceramic (china) portions are adhered one to the other by an ultraviolet-curing adhesive which creates a substantially strong adhesion and is substantially translucent when cured.

Fine crystals and china have been extensively used in the manufacture of fine dinnerware, such as stemware. Fine glass stemware is known as crystal, and generally comprises a leaded glass. Glass is a hard, brittle, amorphous material which is usually transparent but may be colored or translucent, being substantially a supercooled liquid that forms a non-crystalline solid. Most glasses fall into the category of silicates ($SiO_4$ tetrahedron) containing modifiers and intermediates. Fine crystals are made particularly from lead glasses in which PbO is introduced into the vitreous silicon-oxygen glass network. Fine crystals are typically made by converting raw materials at high temperatures to viscous melts that are formed to shape by blowing, pressing, casting and/or spinning. Application of the hot glass melt to a mold or the like also cools the glass and sets the final shape. The formed glass may also be annealed, tempered, densified or compacted by post-forming heat treatments.

Stemware and other glasses are subjected to a range of temperatures in use. The thermal expansion properties of glass normally determine the range of materials to which the glass can be adhered or fused. Thermal expansion also affects the glass's internal ability to survive thermal shock or cycling. Strains and stresses caused by thermal gradients may cause cracks or breakage of the glass. Means adhering or fusing the glass to a distinct glass or to another material for mounting may fail during thermal cycling, depending on the degree of constraint imposed by the external mounting material and the respective thermal expansion characteristics. Crystal typically has a higher thermal expansion coefficient than china, or ceramics in general.

China is a ceramic material which is comprised chiefly of kaolinite ($Al_2(OH)_4Si_2O_5$). China is extensively used in whitewares. Ceramics generally are formed and then fired to sinter adjacent particles, by a high temperature firing process typically in a kiln, to form a china bisque having the desired shape. The formed china is also typically glazed for use as whiteware, and can be decorated prior to or in connection with glazing, by application of colored coating patterns that are set during post heat treatments.

Whereas there are a number of different decorative aspects possible with glass and china, respectively, it would be advantageous if it were possible to employ both materials together and thereby set off the decorative attributes of one with the other. However, previous attempts by the present inventors to produce such a piece of stemware, for example a goblet comprising an integral crystal bowl and crystal stem, and a china foot, have been largely unsuccessful due to the consequences of differences of thermal expansion. Either over the short term or long term, the joint between the glass and china fails or stresses applied to the glass or china result in breakage.

Glass can be joined at a seam or the like by fusing, and low melting temperature glasses or "frit" are known to be useful for fusing, normally at a glass-to-glass seam. The inventors have attempted to fuse crystal and china portions together at a joint located at the lower end portion of a glassware stem and the upper portion of the foot. Fusing would be advantageous since a fused joint is continuous across the joint, i.e., not characterized by a gap or similar visually perceptible feature. However, both glass and china are relatively brittle materials that tend to fail by sudden cracking. Due to this aspect of the crystal and china materials and their thermal expansion mismatch, thermal cycling of stemware with a fused joint causes the formation of strains and stresses at the joint, and in particular in and adjacent the crystal. Upon cooling or with thermal cycling, the materials crack or the crystal-china bond fails.

It would be desirable to bond a crystal substrate and china substrate at a joint which is durable and continuous, thereby forming a stemware assembly composite of crystal and china components. It would also be desirable to combine crystal and china portions of the stemware using a bonding agent at the joint that is similar in appearance to glass or china, preferably substantially translucent or transparent when cured, and which deals with the mechanical problems associated with the different thermal expansion characteristics of china and glass.

SUMMARY OF THE INVENTION

It is an object of the invention to provide a tableware assembly wherein at least one of the portions is crystal and at least another adjacent portion is china, such that the crystal and china portions are durably joined notwithstanding different thermal expansion characteristics.

It is a related object to join foot, stem and bowl portions of a piece of stemware wherein at least two adjacent such portions are siliceous materials with different thermal expansion properties, by attaching the portions using an ultraviolet-curing adhesive.

It is another object of the invention to bond durably and substantially transparently or translucently, especially invisibly, a crystal glass portion of a stemware assembly, preferably a crystal glass stem, to a china portion of a stemware assembly, preferably a disk-like china foot.

It is yet another object of the invention to provide a goblet having a glass stem and a ceramic foot, wherein the stem and foot are permanently attached.

It is a feature of the invention to join crystal and china using an ultraviolet-curable adhesive.

It is an advantage of the invention to provide a binding agent for dissimilar ceramic, preferably china, and glass, preferably crystal, portions of a stemware assembly which avoids the thermal expansion mismatch characteristics of the two dissimilar materials and which bonds the two materials substantially durably and translucently.

These and other objects, features, and advantages of the invention are met by providing a stemware assembly, such as a goblet, including a foot having a generally circular or disk shaped body comprising a ceramic material, preferably china, in which the foot has a lower base portion providing stable support on a generally horizontal surface, and an upper portion having receiving means for a stem. A stem is dimensioned to fit in the receiving means of the china body, the stem having a generally cylindrical body longitudinally extending along a length and comprising a glass material, preferably crystal. At an upper end the stem is joined to a bowl, also comprising a glass material, preferably crystal that is integral with or fused to the stem. At its lower end the stem has engaging means at the terminus that fits into the receiving means of the china body to engage mechanically. The glass stem and the ceramic foot are permanently attached by a joint formed by an effective amount of an adhesive, preferably an ultraviolet-curing adhesive, which is substantially durable and suitably translucent upon cure, and accommodates the thermal expansion mismatch of the glass and china by buffering forces applied between the two materials during thermal cycling.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
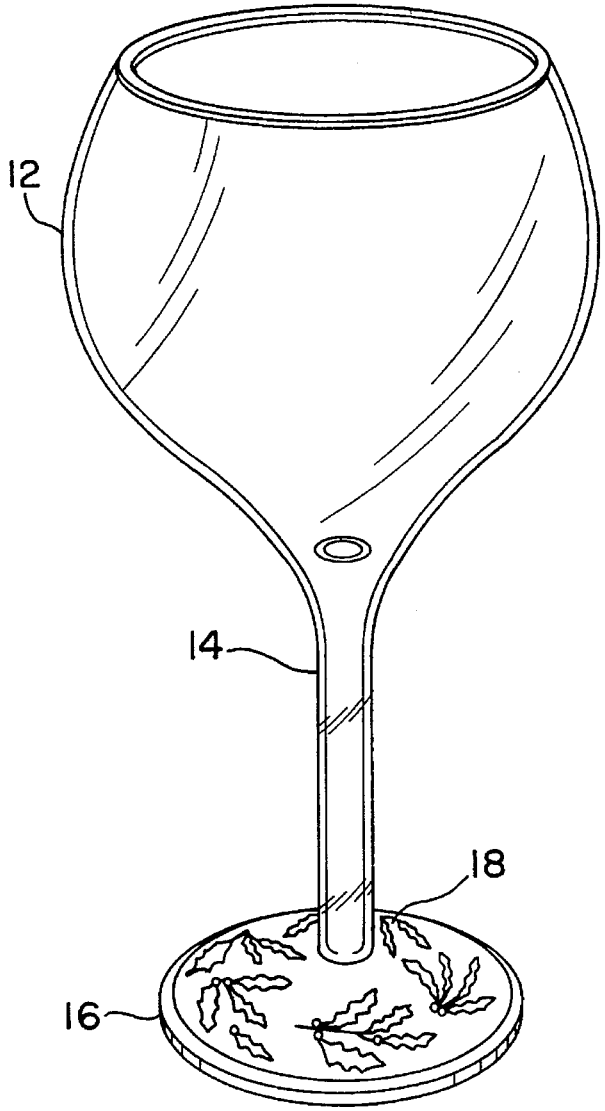
FIG. 1 is a perspective view of a crystal glass goblet having a crystal glass stem and a china foot, according to an embodiment of the invention.

Referring to FIG. 1, the invention is particularly applicable to an article of stemware 10, such as a goblet. Stemware article 10 includes a bowl portion 12, a stem portion 14 and a foot portion 16. The goblet may be configured in a size or shape as conventionally used for drinking water, wine, champagne or the like, as an element of a fine china and crystal table setting.

In the embodiment shown, the bowl and stem portions are integrally formed of a transparent and/or translucent glass material such as lead crystal. The foot comprises an opaque ceramic material, i.e., china. According to the invention, these two portions of dissimilar material, i.e., a glass portion and a ceramic portion that have different thermal expansion properties, are joined to provide an article of stemware that is durably and translucently bonded at a joint 18, preferably at the base of the stem.

The invention is described with respect to an integral bowl 12 and stem 14 of glass, and an integral base 16 of ceramic. It will be appreciated that it would also be possible to provide a different configuration such as a ceramic bowl portion (not shown) joined to an integral glass stem and foot, or any combination of glass and ceramic materials wherein at least one joint 18 is provided between the glass and ceramic, and contains an adhesive material that bonds securely to the glass and china and buffers the difference in their thermal expansion properties.

The foot 16 of the stemware is preferably made of an opaque material, such as china. The ceramic can be a china, porcelain, earthenware, pottery or the like, although china is preferred for a fine tableware setting. The ceramic foot, for example china, preferably is thermally formed to a bisque from a molded green body by a conventional high temperature firing process, for example in a conventional kiln. A pyroceramic or similar process is also possible. The ceramic, for example, china bisque, once formed is preferably decorated, glazed, polished and/or decorated by conventional post heat treatment techniques for china or the like.

As shown in FIG. 1, the ceramic foot preferably is generally circular in shape. The function of the foot is substantially only to support the stemware article in a stable manner and it should be understood that other shapes could likewise be used for this purpose. In the embodiment, the foot is downwardly convexly shaped or domed, having a lower base portion defining a planar periphery for standing on a generally horizontal surface. An upper surface portion is decorated and structured for engaging the stem.

Figure 3:
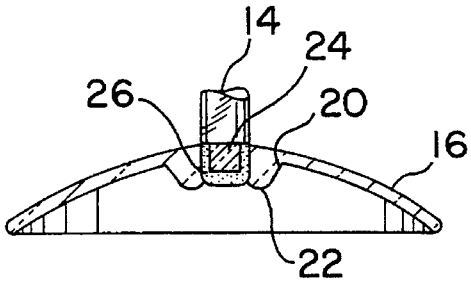
FIG. 3 is a section view of a foot portion of the goblet according to FIG. 1, with an opaque ceramic foot and a translucent and/or transparent glass stem, coupled at a joint comprising an ultraviolet radiation curing adhesive which is suitably translucent when cured, disposed between the glass and ceramic at the joint.

Preferably, as more particularly shown in FIG. 3, at the center of the foot's upper surface, a hub or well 20 is provided for receiving the stem. The well 20 can be defined as a thickening of the body of the foot, with an opening formed therein having a diameter for fitting the stem. The well is of a sufficient depth to provide mechanical support for stem 14 and bowl 12 prior to bonding and sufficient surface area to provide a permanent and secure interconnection joint between the foot and stem when the adhesive is cured in place between and in engagement with the stem and the foot. The well or hub 20 can be reinforced by forming a dimple 22 on the underside of the well which projects upwardly in the well.

As shown in FIG. 1, the stem 14 of the stemware is preferably made of a transparent and/or translucent material, such as a glass material. Preferably, the glass is lead crystal although other glasses such as soda-lime glass or the like can also be used. Glass is also conventionally formed thermally by a conventional high temperature melting process into a viscous melt and shaped by blowing, pressing, casting and/or spinning the glass against a mold to cool and set the final shape.

Figure 2:
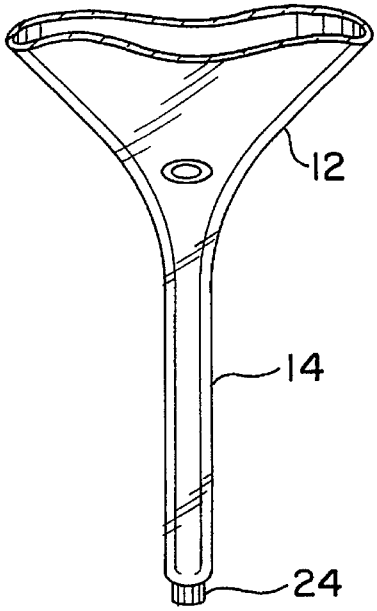
FIG. 2 is a cutaway view of a portion of the goblet of FIG. 1, showing the base of the crystal stem, having a shouldered stub for coupling with a corresponding receptacle in the china foot.

In the embodiment shown in FIG. 1, stem 14 has a generally cylindrical shape and longitudinally extends along a straight length. It should be understood that other cross sectional shapes, bends, twists and other configurations could likewise be used. Preferably, as shown in FIG. 2, the lower end or base 24 of the stem has a diameter somewhat smaller than the shaft of the stem proceeding upwardly, thereby forming a pin that fits into well 20 and a shoulder that rests against the upper surface of foot 16. This reduced diameter end and shoulder can be molded, ground, turned, or similarly formed to a diameter whereby the stem fits snugly within the well 20 of the foot to provide substantially an interference fit between the foot and the stem, with sufficient clearance to permit variations caused by thermal expansion without unduly stressing the stem or foot.

Figure 4:
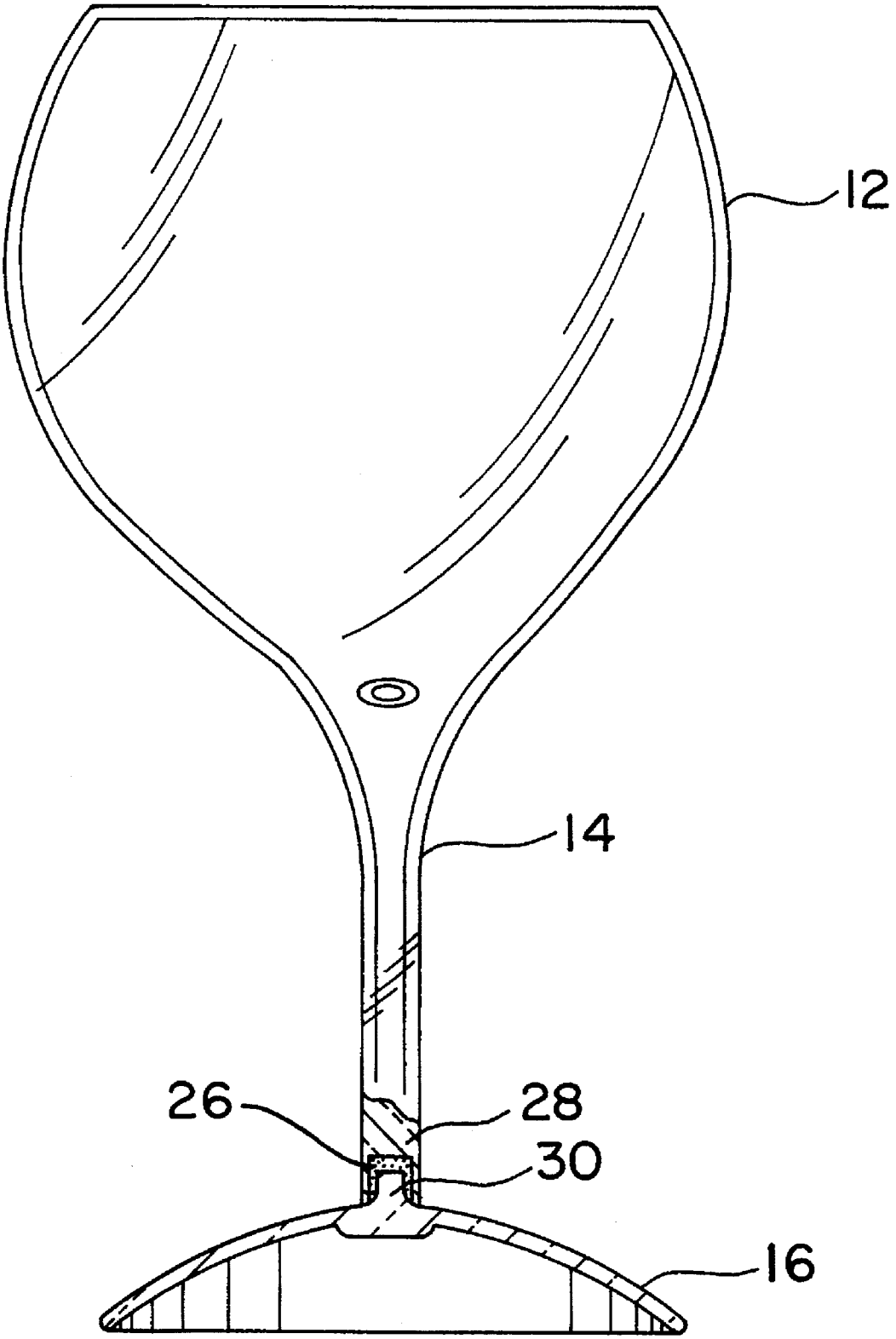
FIG. 4 is a section view of a crystal glass goblet having a crystal stem and a china foot coupled at a joint with ultraviolet radiation curing adhesive, according to an alternate embodiment of the invention.

In the embodiment shown the stem forms the male part and the base forms the female pan. The male and female mating of the stem and foot can be reversed or differently configured. For example, as shown in FIG. 4, an axial cavity 28 can be formed in the glass lower portion of the stem, engaging a glass or ceramic pin 30 of a smaller diameter projecting upward from the upper portion of the foot. A glass pin in that case would be attached to the foot in the same manner as shown. Alternatively, a ceramic pin could be formed integrally with the foot or bonded thereto. As a further alternative, the receptacle in the well can be the same diameter as the stem (rather than using a smaller diameter stub or end to form a shoulder on the stem as shown). In that case the stem is simply inserted into and bottoms out in the receptacle formed by the well 20. Only a slight spacing is needed for the adhesive to be disposed between stem 14 and well 20.

The upper end of the stem generally terminates in a bowl 12 for holding liquids, foods, etc. The bowl is preferably made of the same glass material as the preferred glass stem and further is preferably integral with the stem or fused together with the stem in a conventional glass-glass joint, to provide a stable connection at the base of the bowl to the stem.

Referring to FIG. 3, the bond between the glass stem, preferably crystal, and the ceramic foot, preferably china, is achieved by a translucent ceramic adhesive 26, preferably an ultraviolet-curing adhesive. The ultraviolet-curing adhesive is applied in an effective amount within and around the well 20 in the ceramic foot, preferably a ceramic bisque, prior to fitting the end or base 24 of stem 14 into the well 20 of foot 16. The ultraviolet-curing adhesive is advantageous, since no heat is required to make the bond and thermal expansion is therefore not a factor. Thermal heat would be undesirable because of the thermal expansion mismatch of the ceramic foot and the glass stem. Further, the ultraviolet-curing adhesive is advantageous, since it provides a translucent and/or transparent material when cured and also a sufficiently durable bond. This is desirable because an unclean adhesive bond would detract from the appearance of the stemware. Moreover, since light radiation cures the adhesive, the curing radiation can be applied in part through the transparent or translucent stem. The ultraviolet-curing adhesive is preferably exposed to ultraviolet radiation for about 1 to 2 minutes.

The ultraviolet adhesive can be Sun-Set glass adhesive sold by Lumen-Essence of Troy, Mich. and Impruv optically clear uv adhesive sold by Loctite of Newington, Conn. These adhesives have the following compositions:

| Sun-Set | | Impruv | |
|---|---|---|---|
| Ingredients | % by WT. | Ingredients | % by WT. |
| Polyurethane Dimethacrylates | 35–40 | Polyurethane Methacrylate | 45–50 |
| Polyglycol Dimethacrylate | 10–15 | High Boiling Methacrylate | 20–25 |
| Hydroxyalkayl Methacrylate | 10–15 | Hydroxyalkyl Methacrylate | 15–20 |
| High Boiling Methacrylate Ester | 15–20 | Alkyl Methacrylate | 5–15 |
| 1 Methacrylate | 10–15 | Acrylic Acid | 5–7 |
| Acrylic Acid | 3–5 | Alkyl Methacrylate | 3–5 |
| Glycidoxysilane Derivative | 1–3 | Substituted Silane | 1–3 |
| Proprietary Photosensitizer | 1–3 | Photoinitiator | 1–3 |

The inside diameter of receptacle in well 20 is preferably about 0.375 inches greater than the outside diameter of the stem in the area of engagement. The axial length of engagement between the stem and the foot can be about 0.15625 to 0.1875 inches. These dimensions provide sufficient surface area and radial clearance for the adhesive, to provide an adequate bond and suitable buffering between the differently expanding glass and ceramic over the expected temperature range of about 80° F. to 100° F.

Prior to applying the adhesive, the well 20 of ceramic foot 16 and/or the end or base 24 of stem 14, may be provided with a reflective or mirror coating perpendicular to the longitudinal extension of the stem, to avoid undesirable reflections from either the opaque foot or translucent adhesive which projects an opaque image up through the stem to the bottom of the bowl.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A stemware assembly comprising:

a foot comprising a generally circular body formed of a china material, said foot having a lower base portion for standing on a generally horizontal surface and an upper portion having receiving means for fittingly receiving a stem;

the stem comprising a generally cylindrical body longitudinally extending along a length formed of a crystal material, said stem having an upper end integrally fused to a bowl comprising a generally convex body formed of a crystal material and a lower end having engaging means to fit said foot; and, wherein said lower end of said crystal stem and said upper portion of said china foot are joined together by a translucent, ultraviolet-curing adhesive disposed between said stem engaging means and said foot receiving means, thereby bonding said crystal stem to said china foot.

2. The stemware assembly of claim 1, wherein the receiving means of said foot forms a recess projecting downward within the upper portion of said foot having a diameter and a depth and the engaging means of said stem comprises a shoulder spaced from a terminus of the lower end of said stem, said lower end being dimensioned to fit within the recess.

3. The stemware assembly of claim 2, wherein the recess has a dimple projecting upward from an underside of the recess to within the recess.

4. The stemware assembly of claim 1, wherein the receiving means of said foot comprises a stub having a diameter less than a diameter of the stem and projecting upward from the foot and the engaging means of said stem comprises an axial cavity having a diameter in the lower terminal end of said stem formed to fit over the stub.

5. The stemware assembly of claim 1, wherein the translucent, ultraviolet-curing adhesive is a methacrylate based resin adhesive.

6. The stemware assembly of claim 1, wherein the stemware is a goblet.

7. A glass goblet having a glass stem comprising a longitudinally extending body having an upper and lower end, a glass bowl comprising a generally convex body attached to the upper end of the glass stem, and a ceramic foot comprising a horizontally supporting body attached to the lower end of the glass stem, wherein said glass stem lower end is attached at a joint on said ceratinic foot with an ultraviolet-curing adhesive that is suitably translucent when cured.

8. The goblet of claim 7, wherein the foot is china.

9. The goblet of claim 7, wherein the foot is porcelain.

10. The goblet of claim 7, wherein the foot is earthenware.

11. The goblet of claim 7, wherein the glass is crystal glass.

12. The goblet of claim 7, wherein the glass is soda-lime glass.

13. The goblet of claim 7, wherein the foot is substantially circular having a decorative surface and the stem is substantially cylindrical.

14. The goblet of claim 7, wherein the foot comprises an upper portion having a recess defining means for receiving the lower end of the stem formed to fittingly engage within the recess.

15. The goblet of claim 14, wherein the foot is china and the bowl is crystal glass and is integrally fused to the upper end of the crystal stem.

* * * * *